United States Patent [19]

Perfect

[11] 4,374,667

[45] Feb. 22, 1983

[54] FERROVANADIUM CARBIDE ADDITION AGENTS AND PROCESS FOR THEIR PRODUCTION

[75] Inventor: Frederick H. Perfect, Wyomissing, Pa.

[73] Assignee: Reading Alloys, Inc., Robesonia, Pa.

[21] Appl. No.: 311,339

[22] Filed: Oct. 14, 1981

[51] Int. Cl.[3] ..... C22C 35/00

[52] U.S. Cl. ..... 420/424; 75/129; 75/252; 75/256

[58] Field of Search ..... 75/129, 134 V, 252, 75/256

[56] References Cited

U.S. PATENT DOCUMENTS

| | | | |
|---|---|---|---|
| 3,262,776 | 7/1966 | Loeffler | 75/129 |
| 3,334,992 | 8/1967 | Downing | 75/129 |
| 3,375,105 | 3/1968 | Lynch | 75/129 |
| 3,565,610 | 2/1971 | Retelsdorf | 75/129 |
| 3,579,328 | 5/1971 | Aas | 75/129 |
| 3,591,367 | 7/1971 | Perfect | 75/129 |
| 3,982,924 | 9/1976 | Perfect | 75/129 |

*Primary Examiner*—P. D. Rosenberg

*Attorney, Agent, or Firm*—Steele, Gould & Fried

[57] ABSTRACT

Ferrovanadium carbide addition agents comprising 75 to 85% vanadium, 8 to 12% carbon, 8 to 12% iron, less than 2% oxygen and having a density of from about 5.8 to about 6.2. The addition agents are produced by fusing vanadium oxide, iron and carbon at about 1700° C. to about 2100° C.

3 Claims, No Drawings

FERROVANADIUM CARBIDE ADDITION AGENTS AND PROCESS FOR THEIR PRODUCTION

BACKGROUND OF THE INVENTION

It is routine to use vanadium to increase strength of steel. Many vanadium containing addition agents have been developed and used for this purpose. For example, U.S. Pat. No. 1,715,867 describes a ferrovanadium addition agent containing 85 to 95% vanadium for use in steel making. U.S. Pat. No. 3,334,992 describes an addition agent comprising about 80% vanadium, 10 to 12% carbon, and 2 to 10% iron and less than 2% oxygen. The addition agent of this patent has an average density of 2.8 to 3.4. U.S. Pat. No. 3,982,924 describes a process for producing ferrovanadium carbide addition agents at atmospheric pressure and without the need for use of vacuum furnaces.

The steel making art, of course, desires addition agents which provide the greatest level of vanadium on a weight basis as is possible. It is also desirable that a vanadium containing addition agent contain minimum levels of other elements or impurities which could adversely affect properties of the treated steel. Also, it is important that the addition agent have physical characteristics which will foster dissolution of vanadium when it is added to molten steel. Indeed, most vanadium-carbon containing addition agents known and used prior to this invention are characterized by low density, a factor which limits the level of recovery of vanadium added to steel when slag is present. High density vanadium addition agents, that is, agents having a density of greater than 5 have been known in the art, however, these addition agents contain elements other than vanadium such as manganese and silicon which are often undesirable.

It is an object of this invention to provide a high density, high vanadium content addition agent which is low in oxygen content and which will readily combine with molten steel to produce high strength alloys.

DETAILED DESCRIPTION OF THE INVENTION

The composition of this invention includes ferrovanadium carbide addition agents comprising 75 to 85% vanadium, 8 to 12% carbon, 8 to 12% iron, less than 2% oxygen and having a density of from about 5.8 to about 6.2.

The ferrovanadium carbide addition agents of this invention are prepared in a process comprising mixing and combining (a) vanadium oxide (b) iron and (c) carbon, fusing the combined material at about 1700° C. to about 2100° C. at atmospheric pressure under a reducing atmosphere, the proportional relationship between (a), (b) and (c) being such that the ferrovanadium carbide addition agent recovered comprises 75 to 85% vanadium, 8 to 12% carbon, 8 to 12% iron, less than 2% oxygen and has a density of from about 5.8 to 6.2.

Commercially available vanadium pentoxide containing at least about 98% $V_2O_5$, and vanadium sesquioxide ($V_2O_3$) are suitable sources of vanadium. Preferably, the vanadium oxide is reduced in particle size to 200 mesh, by down, and combined with carbon and iron oxide prior to fusing.

The carbon source may be any commercially available form of carbon such as lamp black, graphite, coke and asphaltic emulsion. Graphite is preferred. The carbonaceous material should be reduced to 200 mesh, by down, prior to mixing with the vanadium oxide and iron oxide and fusing.

The iron source may be iron oxide such as FeO, $Fe_2O_3$ or $Fe_3O_4$. Iron powder is preferred. The iron should be reduced in particle size to about 20 mesh, by down, prior to combining it with carbon and vanadium oxide.

The components which make up the ferrovanadium carbide addition agents of this invention generally vary in purity; therefore, the proportions thereof required to provide the ferrovanadium carbide addition agents of a given composition vary accordingly. Moreover, during the fusing and reduction process, a portion of the carbon reactant reacts with oxygen in the vanadium and iron. Therefore, a sufficient amount of carbon must be present to result in reduction of the metal oxides as well as to form the desired ferrovanadium carbide addition agent.

For these reasons, the respective amount of vanadium oxide, iron and carbon used in preparing the ferrovanadium carbide addition agents is expressed in terms of the composition of the ferrovanadium carbide addition agents produced. That is, the components will be combined in a proportion so as to prepare ferrovanadium carbide addition agents comprising 75 to 85% vanadium, 8 to 12% carbon, 8 to 12% iron and less than 2% oxygen.

The carbon source and vanadium oxide are each reduced to a particle size of at least 200 mesh, by down, and combined with iron to form a substantially uniform mixture. The combined components are then compacted or briquetted with mechanical pressure and the aid of a binder such as starch. Compacting can be carried out with any suitable apparatus such as a briquetting machine with the application of pressures on the order of 7,000 psi or more. The compacted mass generally has a density of about 2.2 to about 3.0 grams per cc. The density of the compacted mass may be increased by increasing the pressure applied during the compacting procedure. The compacted mixture may be made in any desired shape and size. Suitable forms include briquettes of rectangular cross-section and other shapes, although pillow shaped briquettes approximately 50 mm long, 25 mm wide and 20 mm thick are preferred.

The compacted mixture of vanadium oxide, iron, and carbon is then fused in a reducing furnace such as an arc furnace, at a temperature of from about 1700° to about 2100° C. At these temperatures, the vanadium oxide is reduced with the liberation of carbon monoxide and carbon dioxide as fusion of the material occurs. No special pressure conditions are required for the fusion, which is generally carried out at atmospheric pressure. Minimal or no slag forms in the fusion process. The addition alloy is recovered from the furnace and broken into a convenient size for addition in steel making such as, for example, 2" by ½" pieces.

The fused ferrovanadium carbide addition agents of this invention have a density of 5.8 to 6.2. It is unexpected and surprising to obtain ferrovanadium carbide addition agents containing such high levels of vanadium and having a density of 5.8 to 6.2 without experiencing a concomitantly high level of oxygen. It has been found, however, that the fused ferrovanadium carbide addition agents of this invention have oxygen levels of 2% or less, typically about ½%. At these levels, the ferrovanadium carbide addition agents are suitable for use in preparing steel alloys.

The invention is further illustrated in the following examples:

EXAMPLE 1

1,155 lbs. of iron power, 17,378 lbs. of vanadium ($V_2O_5$), 384 lbs. of recycled ferrovanadium carbide containing 220 lbs. of vanadium, 5,775 lbs. of graphite, and 1,001 lbs. of starch binder are blended and pressed into pillow shapes. The $V_2O_5$ and graphite are reduced to a particle size of −200 mesh prior to mixing. The compacted mixture, which has a density of 2.5 g. per cc., is sintered in a furnace at a temperature of about 1700° to 2100° C. The fused ferrovanadium carbide has an anlysis of 79.5% vanadium, 9.8% carbon, 9.8% iron, 0.01% phosphorous, 0.16% silicon, 0.02% sulphur, 0.016% nitrogen and 0.49% oxygen. The ferrovanadium carbide addition agent had a density of 5.9 g. per cc.

Having thus described the invention,

What is claimed is:

1. A ferrovanadium carbide addition agent comprising 75 to 85% vanadium, 8 to 12% carbon, 8 to 12% iron, less than 2% oxygen and having a density of from about 5.8 to about 6.2.

2. The ferrovanadium carbide addition agent of claim 1 comprising 78 to 82% vanadium, 9 to 11% carbon, 9 to 11% iron and less than 1% oxygen.

3. A process for preparing ferrovanadium carbide addition agents having a density of from about 5.8 to 6.2 comprising mixing and combining (a) vanadium oxide, (b) iron and (c) carbon, fusing the combined material at about 1700° C. to about 2100° C. at atmospheric pressure under a reducing atmosphere, the proportional relationship between (a), (b) and (c) being such that the ferrovanadium carbide addition agent recovered comprises 75 to 85% vanadium, 8 to 12% carbon, 8 to 12% iron and less than 2% oxygen.

* * * * *